US009901144B2

(12) United States Patent
Koprowicz et al.

(10) Patent No.: US 9,901,144 B2
(45) Date of Patent: Feb. 27, 2018

(54) SEATBELT BUCKLING DEVICE AND SYSTEM

(71) Applicant: Autoliv ASP, Inc., Ogden, UT (US)

(72) Inventors: Chris Koprowicz, Macomb, MI (US); Juan Arenas, Rochester Hills, MI (US); Jonathon Boughner, Lake Orion, MI (US); Bin Wang, Orion Township, MI (US)

(73) Assignee: AUTOLIV ASP, INC., Ogden, UT (US)

( * ) Notice: Subject to any disclaimer, the term of this patent is extended or adjusted under 35 U.S.C. 154(b) by 322 days.

(21) Appl. No.: 14/528,386

(22) Filed: Oct. 30, 2014

(65) Prior Publication Data

US 2016/0120268 A1 May 5, 2016

(51) Int. Cl.
*A41F 3/04* (2006.01)
*A44B 11/25* (2006.01)

(52) U.S. Cl.
CPC ..... *A44B 11/2523* (2013.01); *A44B 11/2561* (2013.01)

(58) Field of Classification Search
CPC ..... A44B 11/2561; A44B 11/2523
See application file for complete search history.

(56) References Cited

U.S. PATENT DOCUMENTS 4,096,606 A * 6/1978 Stephenson ..... A44B 11/2523 24/641
4,550,474 A 11/1985 Doty et al.
4,642,857 A 2/1987 Ono
4,949,436 A 8/1990 Anscher
5,023,981 A * 6/1991 Anthony ..... A44B 11/2511 24/579.11
5,182,837 A 2/1993 Anthony et al.
5,220,713 A * 6/1993 Lane, Jr. ..... A44B 11/2549 24/628
5,283,933 A * 2/1994 Wiseman ..... A44B 11/2511 24/579.11
5,406,681 A 4/1995 Olson
5,526,556 A 6/1996 Czank
(Continued)

FOREIGN PATENT DOCUMENTS

CA 2 058 733 C 12/1992
EP 0 427 525 A1 5/1991
(Continued)

*Primary Examiner* — Victor Batson
*Assistant Examiner* — Matthew Sullivan
(74) *Attorney, Agent, or Firm* — Brinks Gilson & Lione

(57) ABSTRACT

A seatbelt buckling device and system includes a buckle and a latch plate. The latch plate includes a pair of fingers that extend from a base portion. The buckle includes buckle housing that defines a slot that is configured to receive the fingers of the latch plate. The buckle also includes a blocking member disposed in the slot that splits the slot into first and second slot portions. The first and second slot portions are sized to receive the fingers. The blocking member restricts debris from entering a cavity of the buckle housing. The buckle further includes a depressible button for releasing the latch plate. The blocking member is arranged as a blockout portion integrated into the button or an ejector protrusion extending from an ejector disposed within the buckle.

20 Claims, 6 Drawing Sheets

(56) References Cited

U.S. PATENT DOCUMENTS

| | | | | | |
|---|---|---|---|---|---|
| 5,584,107 | A | * | 12/1996 | Koyanagi | A44B 11/2511 24/632 |
| 5,588,189 | A | * | 12/1996 | Gorman | A44B 11/2511 24/632 |
| 5,813,097 | A | * | 9/1998 | Woellert | A44B 11/2511 24/587.12 |
| 6,049,954 | A | * | 4/2000 | Britto | A44B 11/2511 24/579.11 |
| 2004/0107550 | A1 | | 6/2004 | Lee et al. | |
| 2007/0137009 | A1 | | 6/2007 | Chen | |
| 2008/0040905 | A1 | | 2/2008 | Webber et al. | |
| 2010/0244543 | A1 | | 9/2010 | Fine et al. | |

FOREIGN PATENT DOCUMENTS

| | | | |
|---|---|---|---|
| EP | 0 557 983 | A1 | 9/1993 |
| EP | 0 901 943 | A2 | 3/1999 |
| KR | 20-0416588 | Y1 | 5/2006 |
| WO | 20141025243 | A1 | 2/2014 |

* cited by examiner

SEATBELT BUCKLING DEVICE AND SYSTEM

FIELD OF THE INVENTION

This invention relates to a seatbelt buckling device adapted for use as part of a motor vehicle occupant restraint system.

BACKGROUND OF THE INVENTION

Seatbelt assemblies and systems are in widespread use in motor vehicles. Present systems have certain common elements including seatbelt webbing which extends across the upper and lower torso of the occupant, and a retractor for allowing protraction and retraction of the webbing so that the belt may adapt to different sizes of occupants and be conveniently out of the way when not being used. Seatbelt assemblies further typically include a buckle which releasably attaches to a latch plate.

Seatbelt assemblies must be securely affixed to motor vehicle structural elements in order to provide the necessary restraint effect in vehicle impact conditions and further to meet government regulations. Further, seatbelt assemblies must securely retain an occupant within its seat, while also allowing the occupant easy ingress and egress from the seat under a variety of conditions and situations.

Typical seatbelt assemblies include a buckle that is securely mounted to a vehicle structure, such as a seat frame or the floor of the occupant compartment. The buckle typically includes a slot that is sized to receive and retain a latch plate.

The latch plate is typically attached to the seatbelt webbing. The seatbelt webbing is typically fixed to the vehicle structure at one end, and the opposite end is typically fixed to a retractor having an internal spool that is configured to protract and retract the webbing in response to various loads. The latch plate is typically attached by passing the seatbelt webbing through an elongate opening or slot, such that the latch plate can slide along the webbing and be adjusted relative to the size of the occupant. The latch plate is typically attached to webbing such that the latch plate remains on the webbing, whether the seatbelt is in the buckled or unbuckled configuration.

The buckle is typically in the form of a housing that includes a pushbutton. A single slot is provided at the top of the buckle and defined between the pushbutton and the housing, into which a single latch plate is inserted. In other forms, the pushbutton is provided on the side of the housing, and the housing defines the slot at the top of the buckle.

Because the seatbelt is inherently inserted and removed multiple times through the course of its life, there are prolonged instances where the seatbelt is in an unbuckled condition. In this condition, the slot at the top of the housing is open and capable of receiving the latch plate when buckling is desired by the occupant.

In some approaches, the buckle is maintained in an upright position to provide easier access to the occupant. In other approaches, the buckle may lay flat against the vehicle seat. Often, the buckle is recessed in a vehicle seat to provide a low profile vehicle seat.

In each of these approaches, the slot is susceptible to debris or other objects being inserted into slot or inadvertently falling into the slot. Such debris can include coins, pins, paperclips, gravel, hairpins, rubber bands, or other similar items. Debris becoming lodged within the buckle can interfere with proper buckle operation.

Seatbelt buckles have been developed with smaller slots, but the smaller slot results in a smaller latch that may not meet design criteria. For example, a traditional belt buckle slot has a width extending across the buckle and a height that corresponds to the thickness of the latch plate. The slot also has a depth for receiving at least a portion of the length of the latch plate.

One example of a smaller slot design has been used with child seats that use a pair of separate latch plates in a five point seatbelt design. The smaller slot has a smaller width, while having approximately the same height. These designs require one latch plate to be buckled from one side of the child occupant and a second latch plate to be buckled from the other side. Accordingly, two slots are used, with each slot having a smaller width than a traditional buckle. The latch plates meet at a central buckle that is disposed between the legs of the child occupant. However, such designs are impractical for occupants that have outgrown a child seat. They are more uncomfortable and are difficult to adjust to accommodate occupants of varying sizes. Moreover, the use of two separate latch plates necessarily makes buckling and unbuckling more difficult than a single latch plate and buckle system.

Accordingly, improvements can be made to seatbelt buckling systems that improve on a buckle's resistance to debris.

SUMMARY

A seatbelt buckling system in accordance with this invention provides the advantage of limiting or preventing the debris from entering the buckle slot while maintaining an overall width similar to traditional designs. However, the slot is split into two slot portions, and the widths of each slot portion are smaller than the overall width of a single slot. This will improve the functioning of the buckle, and decrease the instances of required costly repair or replacement. The buckle includes a blocking member disposed within the slot that defines the two slot portions. The blocking member can be in the form of a blockout portion that is integral with the button. The blockout portion defines the smaller widths of the slots. A latch plate has two fingers that are part of a unitary structure. The single latch plate having two fingers resembles a similar latch plate and can be retrofitted to traditional systems. The buckle includes a latch member in the cavity that is pivotable in response to pressing the button. The latch member includes a pair of posts that retain the fingers by being inserted into windows defined by the fingers.

The blocking member can alternatively be in the form of a protrusion from an ejector that is disposed within the buckle. The protrusion extends toward the opening of the buckle slot and thereby splits the slot into two smaller slot portions. The ejector protrusion can be used instead of the blockout portion, because the protrusion blocks the debris from entering the housing. However, the ejector with the protrusion could also be used in addition to the blockout portion in some instances.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
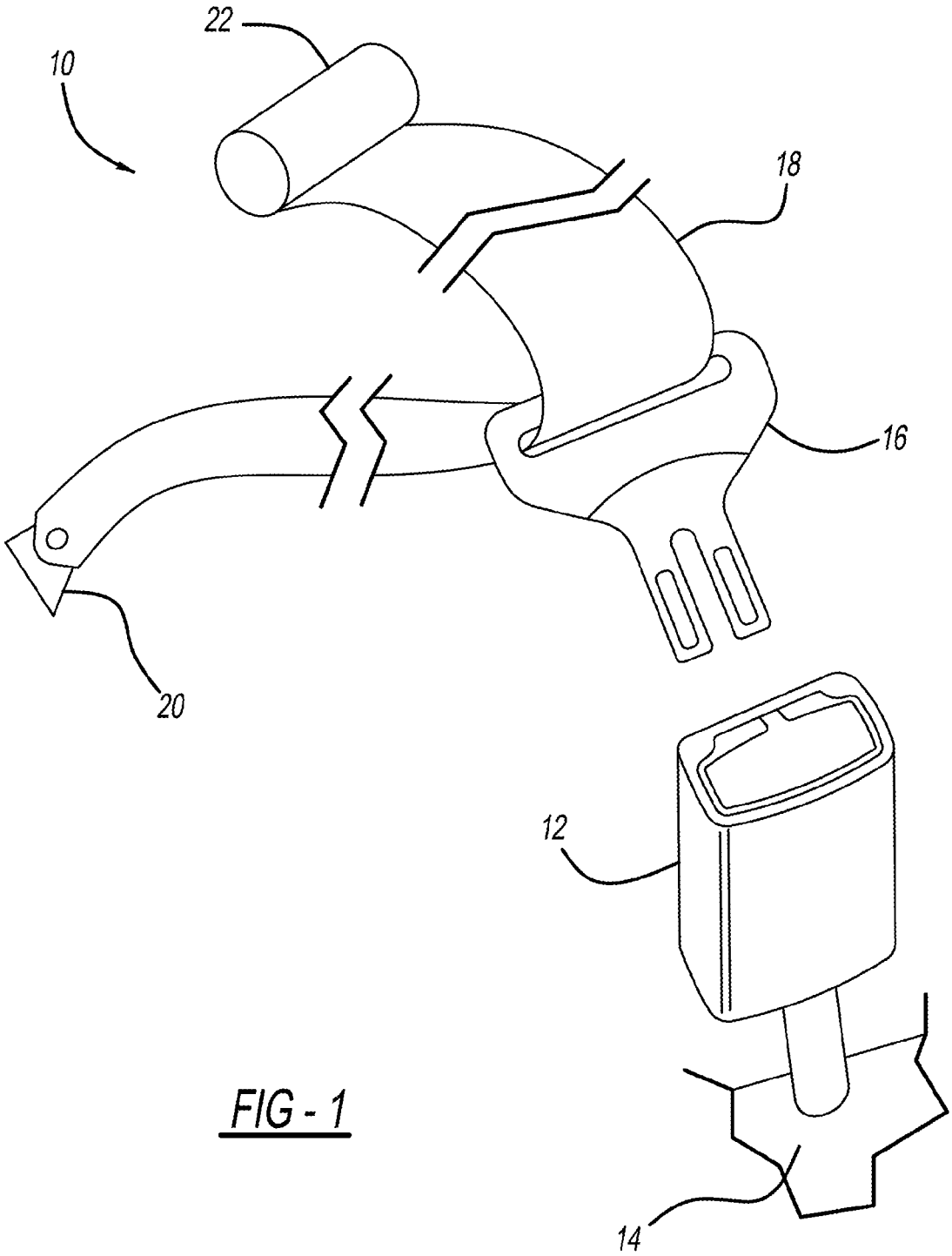
FIG. 1 is an isometric view showing a seatbelt buckling system including a buckle and a latch plate having a pair of fingers.

An occupant restraint system having a seatbelt buckling system 10 in accordance with various embodiments of this invention is illustrated in FIGS. 1-9. With reference to FIG. 1, the system 10 includes a buckle 12 adapted for mounting to a vehicle structure 14 and a latch plate 16 adapted for being received and secured by the buckle 12. The latch plate 16 is further adapted to allow a seatbelt webbing 18 of the system 10 to be retained by the buckle 12 when the latch plate 16 is secured by the buckle.

In one approach, the belt webbing 18 has an anchor 20 at its lower end and a retractor 22 at its upper end. The anchor 20 and retractor 22 may or may not have a pre-tensioner function. Thus, the belt webbing 18 has three points of connection to the vehicle: at the ends of the belt webbing 18 and at the buckle 12 when the latch plate 16 is received and retained by the buckle 12, thereby retaining the webbing 18.

Figure 2:
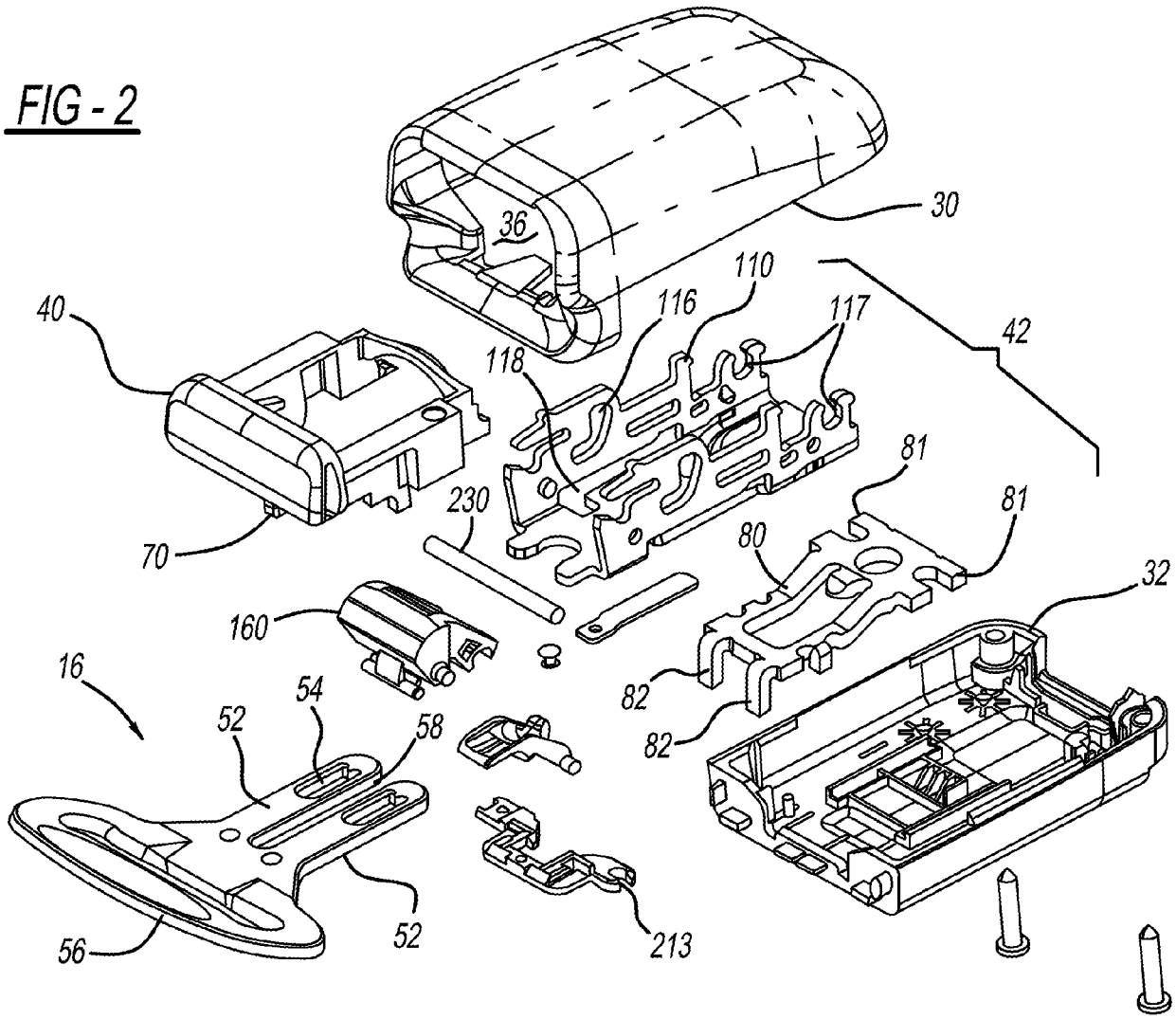
FIG. 2 is an exploded view illustrating the buckle and latch plate, as well as internal components of the buckle.

With reference to FIGS. 1 and 2, the buckle 12 has a generally rectangular cartridge shape. The buckle 12 is comprised of various components that are connected together via known manufacturing methods, such as via adhesives, mechanical fasteners, press fits, or the like. The buckle 12 is shown in FIG. 2 in an exploded view, illustrating various internal components. The buckle 12 includes an outer housing 30 that defines the general outer shape of the buckle 12. The housing 30 has a generally curved shape to provide a comfortable feel to the vehicle occupant.

The buckle 12 also includes a base cover 32 that is coupled to the outer housing 30 to provide a generally enclosed structure. Of course, other manners of provided an enclosed space could also be utilized, such as through injection molding the desired shape. It will be appreciated that other known manners for providing an enclosed space for the buckle 12 are contemplated in this disclosure.

The buckle 12, therefore, also defines an interior cavity 36 within the outer housing 30 and base cover 32. The interior cavity 36 is sized to accommodate various interior components of the buckle 12, some of them fixed and some of them moveable relative to the housing 30 and base cover 32.

Figure 3:
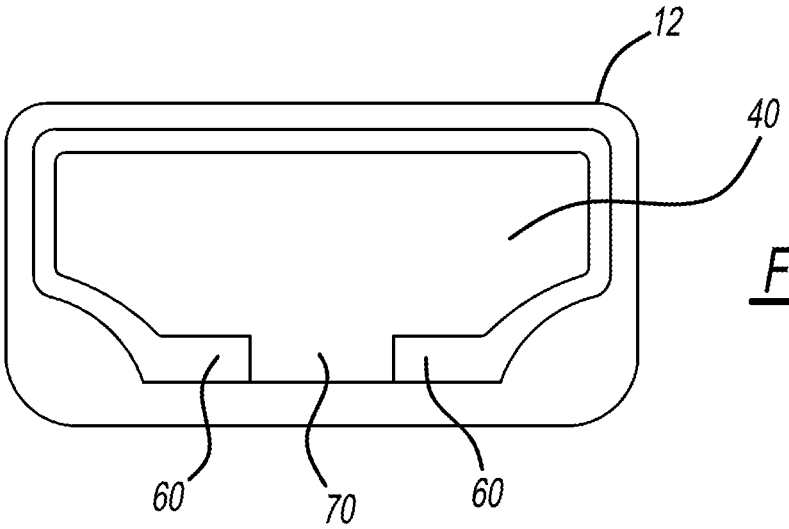
FIG. 3 is a top view of the buckle, showing a blockout portion and pair of generally equal sized slots defined by the buckle and the blockout portion.

For example, and with reference to FIGS. 2 and 3, the buckle 12 includes a pressable button 40 that translates within the buckle 12 relative to the housing 30. The button 40 mechanically cooperates with an assembly of internal components 42 of the buckle 12, causing the internal components 42 to move to release the latch plate 16 in a traditional manner. These internal components 42 are described in further detail below.

The buckle 12, and its internal components 42, have a closed state and an open state. The components 42 and button 40 are biased toward the closed state, such that when the button 40 is not pressed, the components 42 will be in a position to prevent an inserted latch plate 16 from being removed from the buckle 12. Pressing the button 40 against its bias and toward the open state will in turn force the internal components 42 against their bias and into the open state, thereby allowing the latch plate 16 to be removed from the buckle.

The internal components 42 are also arranged to allow the latch plate 16 to be inserted into the buckle 12 without requiring that the button 40 be pressed, as is typical in traditional buckles. The latch plate 16 will cause the components to move upon contacting them, forcing them against their bias. Once the latch plate 16 has been inserted a predetermined distance, the bias of the components 42 will cause them to return to the closed state, thereby retaining the latch plate 16 in the closed position.

As stated above, and with reference to the exploded view of FIG. 2, the latch plate 16 is retained by the internal components 42 of the buckle 12 in a manner similar to conventional buckles. The internal components 42 include a base frame 110 and a latch member 80 that is rotatably coupled to the base member 110. The latch member 80 includes a hinge protrusion 81 that is rotatably inserted in hinge holes 117 of the base member 110. The components 42 further include an ejector 213 and a locking bar 230. The ejector 213 is inserted into an ejector slot 118 of the base frame 110. The locking bar 230 is inserted in a moving slot 116 of the base frame 110. An inertial lever 160 is provided that is coupled to the button 40 and the locking bar 230. When the button 40 is depressed, the locking bar 230 will move along the moving slot 116, forcing the latch member 80 to pivot to an open position, releasing the latch plate 16.

Figure 4:
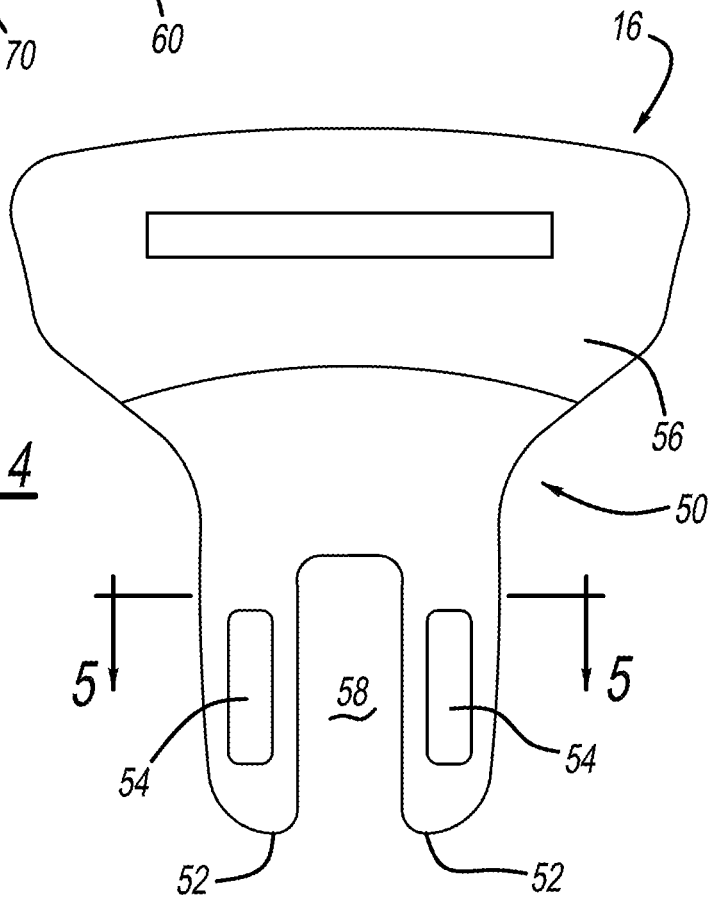
FIG. 4 is a front view of the latch plate, illustrating fingers having generally equal widths.

With reference to FIG. 4, unlike a traditional latch plate, which includes a single tongue portion, the latch plate 16 includes a tongue portion 50 having a pair of fingers 52. Of course, additional fingers could also be used in other approaches. The fingers 52 each define a window 54 in the form of a through-hole extending through the body of each of the fingers 52, such that there are two windows 54 to go along with the two fingers 52. The windows 54 have a generally elongate shape extending in direction parallel to the longitudinal direction of the fingers 52. However, other shapes could also be used in some embodiments, such as a window having the same length and width, or in the form of a circle or oval, or being wider than they are long.

Figure 5:
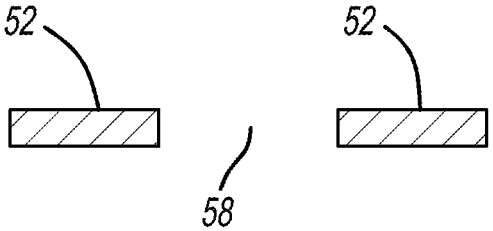
FIG. 5 is a cross-sectional view of the latch plate taken along line 5-5 of FIG. 4.

The tongue 50, including the fingers 52, has a thin and flat shape, similar to a traditional latch plate. The tongue and each of the fingers 52 have a first flat surface on one side and a second flat surface on the opposite side. Accordingly, the tongue 50 and fingers 52 each have a generally rectangular cross-section, as shown in FIG. 5. The fingers 52 extend from a base portion 56 of the latch plate 16, and the base portion 56 is wider than the tongue portion 50 including the fingers 52. The base portion 56, in one approach, is unitary with the fingers 52, with an over-molded portion 57, such as plastic, extending over the structure of the latch plate 16 to define the base portion 56. In another approach, the base portion 56 can be a separate piece from the tongue 50 and attached to the tongue 50 using known attachment methods.

The base portion 56 also has a decreasing taper toward the fingers 52, so that a transverse cross-section decreases toward the fingers 52. The cross-section of the tongue 50 through the fingers 52 appears as pair of rectangles side by side, with a space in between, as shown in FIG. 5.

The tongue 50 also defines an elongate channel 58 between the fingers 52. The channel 58 extends from the end of the fingers 52 to the base portion 56 in a direction parallel to the longitudinal axis of the tongue 50. The channel 58 is accordingly configured to allow an element to be received through the channel 58. Put another way, the tongue 50 having two fingers 52 can be inserted into a pair of openings that are spaced apart by a physical element.

Figure 6:
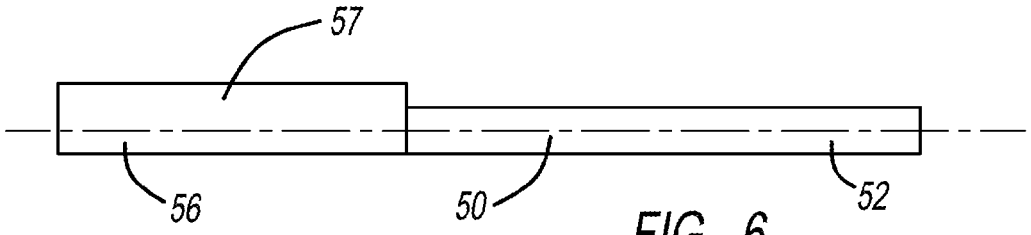
FIG. 6 is a side view of the latch plate, showing a base portion of the latch plate being generally coplanar with the fingers.
Figure 7:
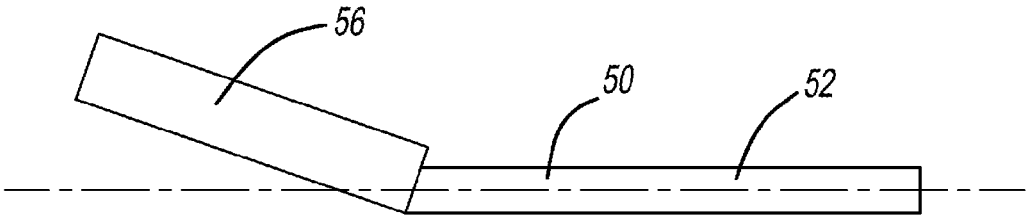
FIG. 7 is a side view of the latch plate showing the latch plate aligned at an angle relative to the fingers.

With reference to FIG. 6, the base portion 56 of the latch plate 16 can lie along the same plane as the tongue 50 and fingers 52, in one approach. In another approach, the base portion 56 can be aligned in a plane that is at an angle to the plane of the tongue 50 and fingers 52, as shown in FIG. 7. In this approach, the relationship of the latch plate 16 relative to the buckle will depend on the orientation of the latch plate 16 when it is inserted.

The fingers 52, in one approach, are the same size and length, as shown in FIG. 4, and are arranged symmetrically on the latch plate 16. In this approach, the latch plate 16 can be inserted regardless of whether it is flipped about its longitudinal axis. Accordingly, fingers 52 having the same size are preferable for the latch plate having a coplanar base portion 56.

Figure 8:
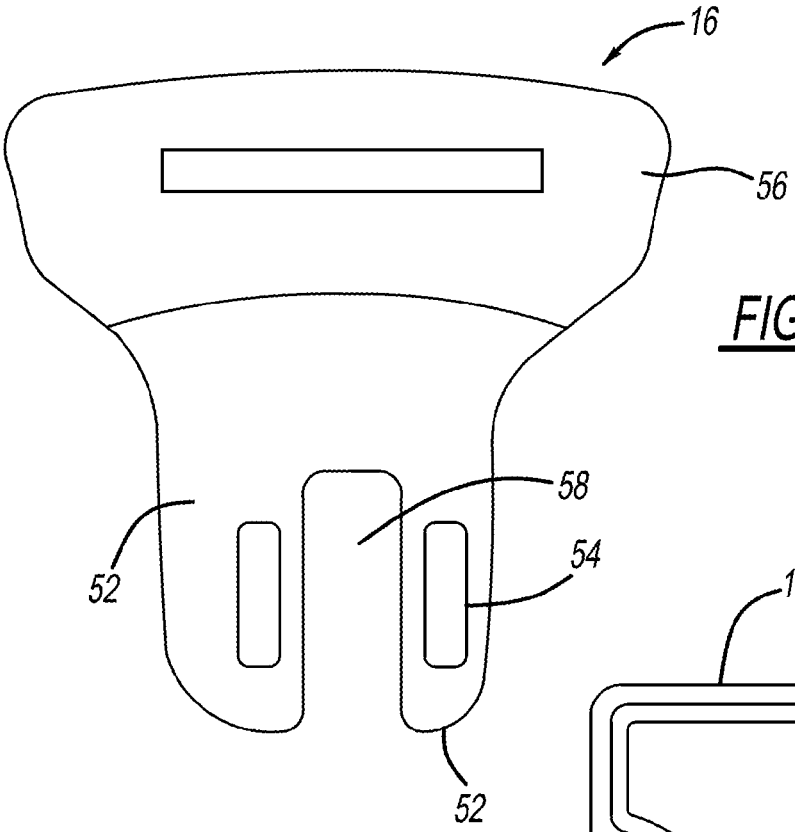
FIG. 8 is a front view of a latch plate having fingers of different widths.

With reference to FIG. 8, in another approach, the fingers 52 have different sizes, and are therefore asymmetrical on the latch plate 16. In this approach, the latch plate 16 can be inserted in one orientation, but not a flipped orientation. This configuration of the fingers 52 may be preferable for the latch plate having an angled base portion 56, so that the base portion 56 is angled in the same direction relative to the buckle 12 when the latch plate is inserted.

It will be appreciated, however, that different sized fingers 52 could be used for the flat latch plate 16 configuration. Similarly, like-sized fingers 52 can be used on the bent latch plate 16 configuration.

The latch plate 16 can be inserted without requiring actuation of the button 40. The latch plate 16 is retained by posts 82 that are received in the windows 54 of the fingers 52. The posts 82 are part of the latch member 80. The latch member 80 is operatively coupled to the button 40, such that depressing the button 40 will pivot the latch member 80, moving the posts 82 out of engagement with the windows 54. Movement of the latch member 80 will cause both posts 82 to move, such that each of the fingers 52 are released at approximately the same time. The ejector 213 is biased in a direction opposite the direction of insertion. When the posts 82 are released from the fingers 52, the ejector 213 will force the fingers 52 and the latch plate away from the posts 80, such that the latch plate 16 will be ejected from the buckle 12, and the latch plate 16 can be removed even if the button 40 is no longer pressed.

With reference to FIG. 3, the buckle 12 and its component parts combine to define a pair of slots 60 that are arranged side by side. The slots 60 are sized and configured to receive the fingers 52 of the latch plate. Preferably, the slots 60 are sized slightly larger than the fingers 52, allowing the fingers 52 to be more easily inserted into the slots 60. However, the slots 60 are not too large such that the fingers 52 and latch plate 16 will not be securely fastened within the buckle 12 when inserted. The slots 60 are separated by a blocking member 69 in the form of a blockout portion 70 that is integrated into the buckle 12. The blockout portion 70, in a preferred approach, is integrated with the button 40. However, the blockout portion could also be integrated with the housing 30 in another approach. Put another way, the buckle 12 defines a slot, and the blockout portion 70 splits the slot and defines first and second slot portions. Other forms of the blocking member 69 will be described later with reference to internal components of the buckle 12.

In one approach, the blockout portion 70 is positioned within the buckle 12 to define a pair of equally sized slots 60, as illustrated in FIG. 3. In this approach, the blockout portion 70 is generally centered on the buckle 12, such that the buckle 12 is symmetrical when viewing the slots 60 from the direction of insertion. In this approach, the latch plate 16 can be inserted in two different 180 degree orientations. This may be preferable in designs where the latch plate 16 can become flipped due to twisting or folding of the seatbelt webbing 18, and where the orientation of the latch plate 16 is immaterial, such as a latch plate 16 that appears the same regardless of 180 degree orientation.

Figure 9:
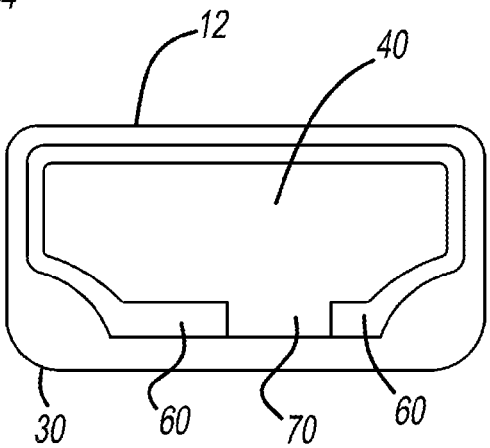
FIG. 9 is a top view of a buckle illustrating a blockout portion in an offset position and defining a pair of slots having different widths.
Figure 10:
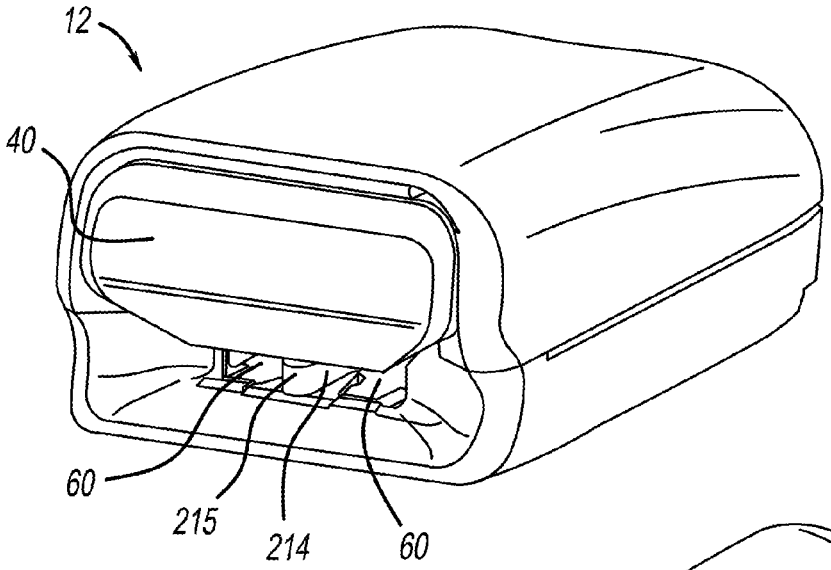
FIG. 10 is an isometric view showing an alternative buckle having a blocking member in the form an ejector protrusion.
Figure 11:
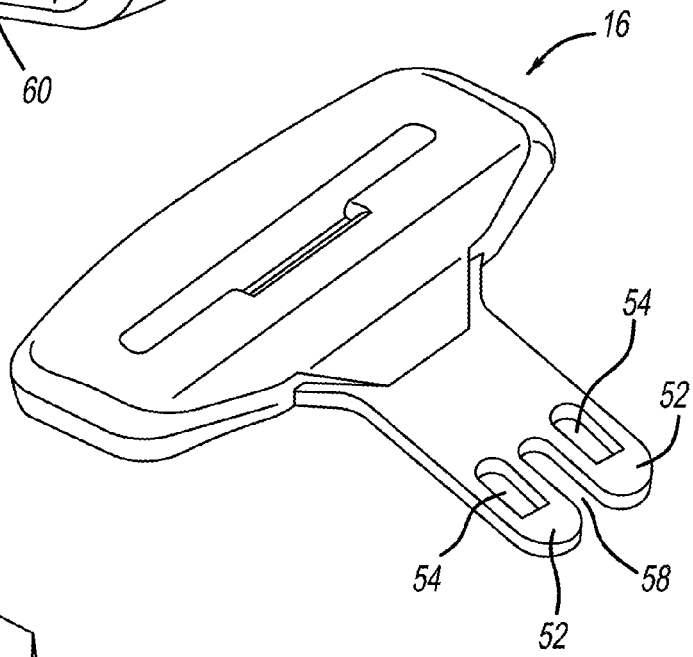
FIG. 11 is an isometric view of an alternative latch plate having shorter fingers than the latch plate of FIG. 2.

With reference to FIG. 9, the blockout portion 70 is offset to one side, either left or right, such that the slots 60 have different widths and the buckle 12 appears asymmetrical when viewed in the direction of insertion. In this approach, the latch plate 16 can be inserted in one particular orientation.

As described above, the fingers 52 can be like-sized or have different sizes. Accordingly, like-sized fingers 52 are used in buckles 12 that have a centered blockout portion 70, and different sized fingers 52 are used for buckles 12 having an offset blockout portion 70.

As described above, the blockout portion 70 is integrated into the buckle 12. With reference to FIG. 3, the blockout portion 70, in one approach, is integrated into the button 40 that moves into and out of the buckle 12. Accordingly, the blockout portion 70 will travel along with the button 40 as it is pressed to release the latch plate 16 from the buckle 12. When the latch plate 16 is inserted into the buckle 12, the blockout portion 70 remains near the top of the buckle 12 and will not move. The insertion of the fingers 52 into the slots 60 will not act against the blockout portion 70. If the latch plate 16 is misaligned during an attempted insertion, the fingers 52 will not enter the slots 60. In the event one of the fingers 52 contacts the blockout portion 70, the latch plate 16 will be restricted from insertion and moving the button, because the other of the fingers 52 will contact the buckle housing 30.

When the latch plate 16 is not inserted into the buckle 12, the blockout portion 70 will remain at the top of the buckle 12, thereby reducing the ability of debris to enter the interior of the buckle 12.

When the button 40 is depressed while the latch plate 16 is inserted, the movement of the blockout portion 70 into the buckle 12 will not increase the ability of debris to enter the buckle 12, because the base portion 56 of the latch plate will span top of the buckle 12, blocking debris.

If the button 40 is depressed when the latch plate 16 is not inserted, it is possible for wider debris to enter the buckle 12 when the blockout portion 70 is inside the buckle. However, the blockout portion 70 will move back toward the top of the buckle 12 when the button returns to the top of the buckle, thereby expelling wider debris that may have entered. Moreover, instances of the button 40 being depressed without the latch plate 16 being inserted are rare, as there is no reason to depress the button 40 if the latch plate 16 is not inserted, as the purpose of the button 40 being depressed is to release the latch plate 16. It does not need to be depressed for the latch plate 16 to enter the buckle 12.

By integrating the blockout portion 70 with the button 40, existing buckle designs can be modified by replacing a traditional button with the button 40 having the blockout portion 70. The remaining portions of the button 40 can remain unchanged. The space occupied by the blockout portion 70 is already present in previous designs, so the blockout portion 70 will simply occupy that space. Similarly, existing latch plates can be replaced by the latch plate 16 having the two fingers 52 that correspond to the widths of the slots 60 defined by the position of the blockout portion 70. The latch member 80 having the two posts 82 that retain the fingers 52 through the windows 54 can replace a traditional latch member having a single post or claw used with traditional single tongue/window designs.

In an alternative approach, the blockout portion 70 is integrated into the buckle housing 30. In this approach, the blockout portion 70 will remain at the top of the buckle 12. It will not move as the button 40 is depressed. This approach can be beneficial to designs where the button 40 is not adjacent the slots 60. For example, the button 40 can be disposed on the side of the buckle 12. This alternative approach can apply to the arrangements shown in FIGS. 1, 3, and 9, but with the blockout portion 70 being integral with the buckle housing 30 instead of the button 40.

As described above, the blockout portion 70 limits the introduction of debris into the buckle 12. The blockout portion 70 cooperates with the fingers 52 of the latch plate 16 to allow the latch plate 16 to be inserted into the buckle 12. The fingers 52 define the channel 58 that is disposed between the fingers 52. The above described ejector 213 cooperates with the end of the latch plate 16 to help eject the latch plate 16 from the buckle 12 when the button 40 is depressed. More particularly, the inserted end of the latch plate 16 forces the ejector further 213 into the buckle 12 and the latch plate 16 is held in place, with the ejector 213 biased against the insertion direction. Once the button 40 is pressed, the latch plate 16 is released, which allows the ejector to force the latch plate 16 out of the buckle 12 in response to the bias of the ejector 213.

The above described ejector 213 has a generally flat surface against which the latch plate 16 acts. This type of ejector can also be used for traditional single tongue latch plates. The above described latch plate 16 with the two fingers 52, however, defines the channel 58 and does not make uninterrupted contact across the ejector 213. When the two fingers 52 make contact with the ejector 213, the contact between ejector 213 and fingers 52 combines to define a closed loop, enclosing the channel 58.

Figure 12:
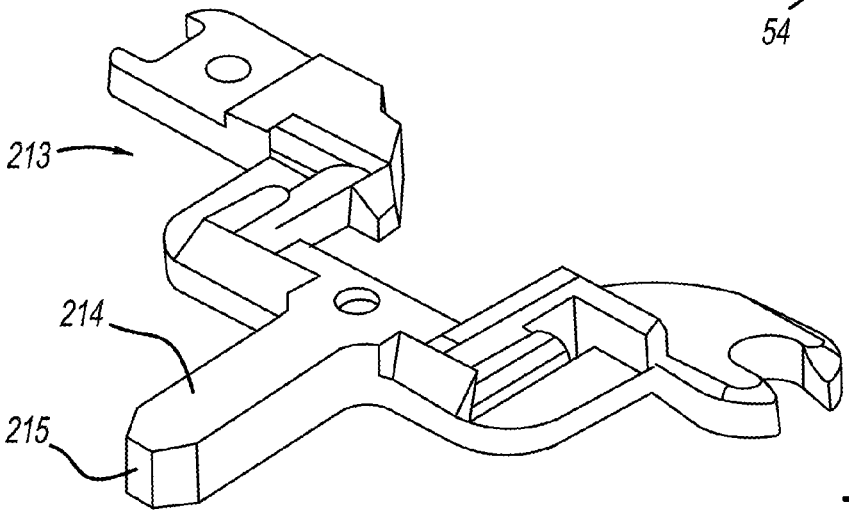
FIG. 12 is an isometric view of an alternative ejector having the ejector protrusion.
Figure 13:
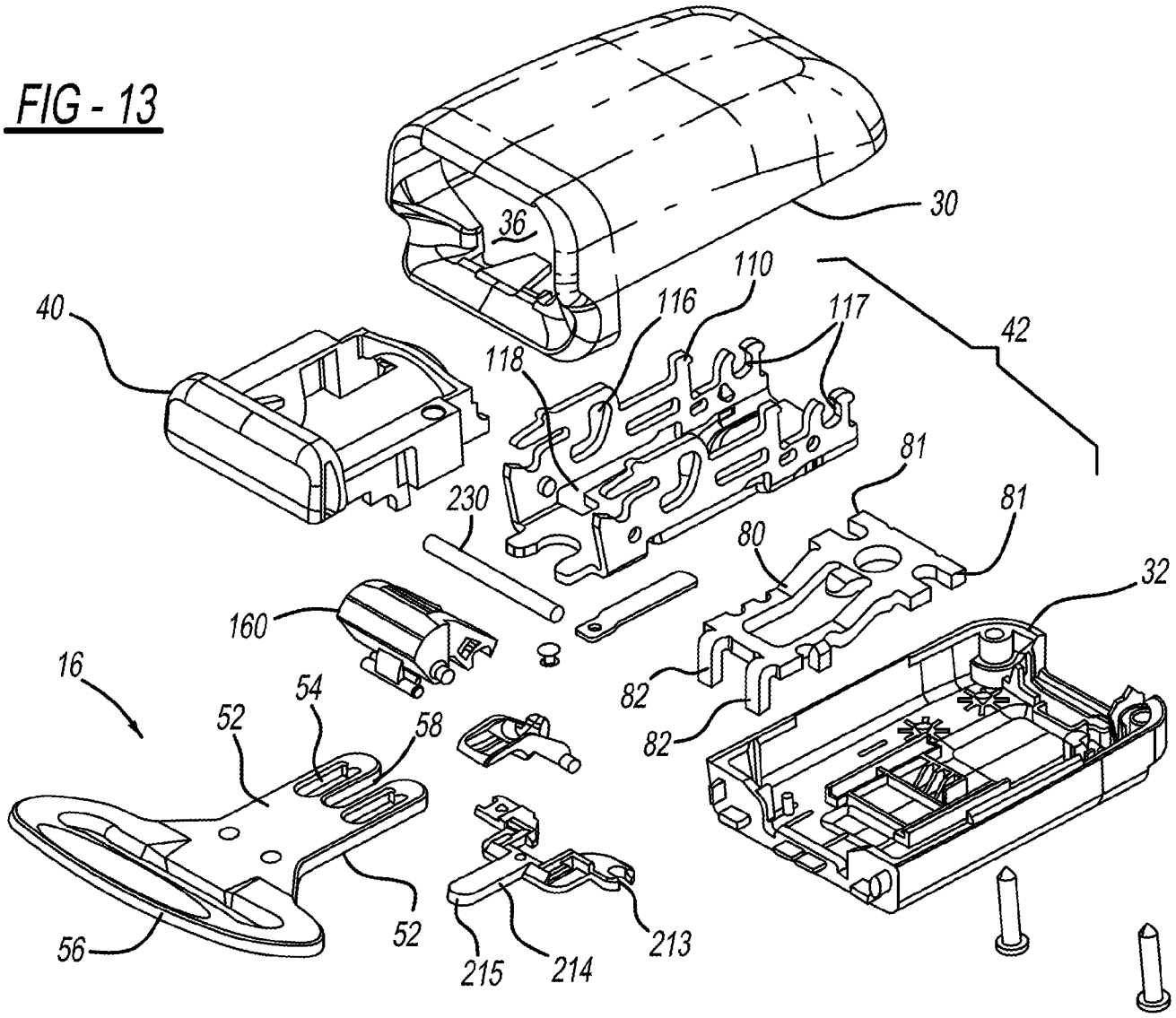
FIG. 13 is an exploded of an alternate buckling system having the buckle of FIG. 10, the latch plate of FIG. 11, and the ejector of FIG. 12.

Accordingly, in another approach and with reference to FIGS. 12 and 13, the ejector 213 can optionally include an ejector protrusion portion 214 that extends longitudinally from the ejector 213 toward the opening of the buckle 12. This elongate protrusion 214 may also reduce the introduction of debris into the buckle 12 in addition to or as an alternative to the blockout portion.

The protrusion portion 214 is sized to have a width corresponding to the spacing between the fingers 52, such that the fingers 52 can move past the protrusion 214 as the latch plate 16 is inserted.

The length of the protrusion portion 214 depends on whether the buckle 12 includes the blockout portion 70 integrated with the button 40. If the blockout portion 70 is included, the blockout portion 70 moves with the button 40 as it pressed. Thus, the blockout portion 70 would move toward the ejector protrusion 214. Accordingly, the ejector protrusion 214, in this approach, has a length that is short enough to allow the button 40 to be depressed without the blockout portion 70 contacting the ejector protrusion 214.

However, in instances where the blockout portion 70 is not integrated with the button 40, for example when the blockout portion 70 is integrated with the housing 30 or if the blockout portion 70 is not used, the length of the protrusion 214 can be longer. In these cases, the button 40 can travel downward into the buckle 12 without interfering with the ejector protrusion 214.

In instances where the blockout portion 70 is in a fixed position, the length of the ejector protrusion 214 is such that it is short enough to remain recessed behind the blockout portion 70 when the ejector 213 is positioned toward the opening of the buckle 12 and not pressed into the buckle 12 by the latch plate 16 being inserted. Thus, the above described ejector 213 having the ejector protrusion 214 can be used in the embodiments of FIGS. 1-9.

However, as mentioned above, the blocking member 69 can also be in the form of an end 215 of the ejector protrusion 214 instead of in the form of the blockout portion 70. The existence of the ejector protrusion 214 allows for the buckle 12 to limit the introduction of debris without using the blockout portion 70. In instances where there is no blockout portion 70, the ejector protrusion 214 itself provides the resistance to debris entering the buckle 12.

With reference to FIGS. 10-13, the end 215 of the ejector protrusion 214 that is disposed near the opening of the buckle 12 is positioned within the slot 60 similar to the positioning of the above described blockout portion 70. The ejector protrusion 214, rather than the blockout portion 70, defines the pair of slots 60. Similar to the blockout portion 70, the ejector protrusion 214 could also be offset to the side to define differently sized slots 60.

In this approach, the button 40 and housing 30 are the same as in a traditional buckle with a single tongue latch plate, such that without the ejector protrusion 214, a traditional single-tongue latch plate could be inserted into the slot 60. The existence of the ejector protrusion 214, however, prevents the instruction of a single-tongue latch plate. The ejector 213 having the ejector protrusion 214 can quickly and efficiently replace the traditional ejector in traditional buckles.

In this approach, the length of the ejector protrusion 214 will generally correspond to the length of the channel 58. Or, put another way, the length of the channel 58 will correspond to the length of the ejector protrusion 214. The protrusion 214 could also be shorter than the length of the channel 58. In this case, a gap would be defined between the end 215 of the protrusion 214 and the end of the channel 58, and the fingers 52 would still contact the ejector 213 to force the ejector inward when the latch plate 16 is inserted. The protrusion 214 can also be longer than the channel 58. In this case, the end 215 of the protrusion will contact the end of the channel 58, but the fingers 52 will not contact the ejector 213. However, the ejector 213 can still operate to eject the latch plate 16 by way of its contact with the latch plate 16 at the end of the channel 58.

The channel 58 and fingers 52 are generally shorter than those used with the blockout portion 70. This shorter channel 58 is the result of the ejector 213 being pushed down in to the buckle 12 when the latch plate 16 is inserted into the buckle 12. As described above, the ejector 213 travels toward the opening when the button 40 is depressed to eject the latch plate 16, and remains near the opening when the latch plate 16 is not inserted. Thus, the end 215 of the ejector protrusion 214 is pushed down into the buckle 12 as the latch plate 16 is inserted. This is in contrast to the blockout portion 70 that remains at the top of the buckle 12 when the latch plate 16 is inserted. Because the ejector 213 and the end 215 of the ejector protrusion 214 move into the buckle 12, the channel 58 does not need to be as long. The length of the ejector protrusion 214 is such that it will extend up to the opening of the buckle 12 when the ejector 213 is disposed toward the opening (when the latch plate 16 is not inserted). With the end 215 of the ejector protrusion 214 disposed at the opening, the ejector protrusion 214 blocks debris from entering the buckle 12 in a manner similar to the blockout portion 70. The protrusion 214 moves away from the opening in response to the latch plate 16 being inserted, and at this point the latch plate 16 is blocking debris, so the movement of the ejector 213 and protrusion 214 does not allow debris to enter after being moved further into the buckle 12.

Thus, the blocking member 69 can be in the form of the blockout portion 70 or alternatively in the form of the ejector protrusion 213. The ejector protrusion 214 can be used without the blockout portion 70, or could be used in addition to the blockout portion 70, if desired.

The above described embodiments provide a buckle system that is resistant to debris entering the buckle 12, while maintaining the traditional size and operation of previous systems. The forces acting on the latch plate 16 are generally in the direction opposite insertion, which are caused when the belt webbing 18 is put under tension during a vehicle deceleration. The unitary structure of the latch plate 16 having two fingers 52 retains a similar tensile strength relative to a single tongue. Accordingly, the buckle 12 and latch plate 16 of the above described embodiments provide similar functionality to a traditional buckle, but with increased resistance to damage and requirement for repair due to foreign objects entering the buckle 12.

While the above description constitutes the preferred embodiment of the present invention, it will be appreciated that the invention is susceptible to modification, variation and change without departing from the proper scope and fair meaning of the accompanying claims.

The invention claimed is:

1. A buckling device for retaining a seatbelt for use in a passenger vehicle, the device comprising:

a seatbelt buckle configured to receive and retain a latch plate having two latchable finger portions, the seatbelt buckle including a housing adapted for mounting to a vehicle structure, the housing defining an internal cavity, the housing defining a first direction of insertion for the latch plate;

a button disposed within the housing and reciprocally moveable in the first direction relative to the housing;

an insertion slot having an overall width defined at least in part by the buckle housing and the button, the insertion slot defining an opening; and a blockout portion being moveable in the first direction relative to the housing and disposed in the insertion slot, the blockout portion blocking a portion of the opening and defining first and second slot portions, wherein the widths of the first and second slot portions are smaller than the overall width of the insertion slot;

wherein the first and second slot portions are configured to receive first and second finger portions of the latch plate.

2. A buckling device for retaining a seatbelt for use in a passenger vehicle, the device comprising:

a seatbelt buckle configured to receive and retain a latch plate having two latchable finger portions, the seatbelt buckle including a housing adapted for mounting to a vehicle structure, the housing defining an internal cavity;

a button disposed within the housing and reciprocally moveable relative to the housing an insertion slot having an overall width defined at least in part by the buckle housing and the button, the insertion slot defining an opening; and a blockout portion being moveable relative to the housing and disposed in the insertion slot, the blockout portion blocking a portion of the opening and defining first and second slot portions, wherein the widths of the first and second slot portions are smaller than the overall width of the insertion slot;

wherein the first and second slot portions are configured to receive first and second finger portions of the latch plate;

wherein the buckle includes a reciprocating latch member disposed within the housing, the latch member configured to retain the latch plate inserted through the first and second slot portions.

3. The device of claim 2, wherein the latch member includes a pair of posts configured to retain the latch plate finger portions.

4. A buckling device for retaining a seatbelt for use in a passenger vehicle, the device comprising:

a seatbelt buckle configured to receive and retain a latch plate having two latchable finger portions, the seatbelt buckle including a housing adapted for mounting to a vehicle structure, the housing defining an internal cavity;

a button disposed within the housing and reciprocally moveable relative to the housing an insertion slot having an overall width defined at least in part by the buckle housing and the button, the insertion slot defining an opening; and a blockout portion being moveable relative to the housing and disposed in the insertion slot, the blockout portion blocking a portion of the opening and defining first and second slot portions, wherein the widths of the first and second slot portions are smaller than the overall width of the insertion slot;

wherein the first and second slot portions are configured to receive first and second finger portions of the latch plate;

wherein the blockout portion is integrally formed with the button and moves with the button.

5. The device of claim 1, further comprising an ejector disposed within the housing, wherein the ejector is biased toward the opening and reciprocally moveable within the housing, wherein the ejector will translate away from the opening in response to insertion of the latch plate into the insertion slot.

6. A buckling device for retaining a seatbelt for use in a passenger vehicle, the device comprising:

a seatbelt buckle configured to receive and retain a latch plate having two latchable finger portions, the seatbelt buckle including a housing adapted for mounting to a vehicle structure, the housing defining an internal cavity;

a button disposed within the housing and reciprocally moveable relative to the housing an insertion slot having an overall width defined at least in part by the buckle housing and the button, the insertion slot defining an opening; and a blockout portion being moveable relative to the housing and disposed in the insertion slot, the blockout portion blocking a portion of the opening and defining first and second slot portions, wherein the widths of the first and second slot portions are smaller than the overall width of the insertion slot;

wherein the first and second slot portions are configured to receive first and second finger portions of the latch plate;

an ejector disposed within the housing, wherein the ejector is biased toward the opening and reciprocally moveable within the housing, wherein the ejector will translate away from the opening in response to insertion of the latch plate into the insertion slot;

wherein the ejector includes an ejector protrusion extending toward the opening, and the blockout portion comprises the ejector protrusion.

7. The device of claim 1, wherein the first and second slot portions have the same width.

8. A buckling device for retaining a seatbelt for use in a passenger vehicle, the device comprising:

a seatbelt buckle configured to receive and retain a latch plate having two latchable finger portions, the seatbelt buckle including a housing adapted for mounting to a vehicle structure, the housing defining an internal cavity;

a button disposed within the housing and reciprocally moveable relative to the housing;

an insertion slot having an overall width defined at least in part by the buckle housing and the button, the insertion slot defining an opening; and a blockout portion being moveable relative to the housing and disposed in the insertion slot, the blockout portion blocking a portion of the opening and defining first and second slot portions, wherein the widths of the first and second slot portions are smaller than the overall width of the insertion slot;

wherein the first and second slot portions are configured to receive first and second finger portions of the latch plate wherein the first and second slot portions have the same width;

wherein the blockout portion is centered on a longitudinal axis of the buckle.

9. The device of claim 1, wherein the first and second slot portions have different widths.

10. The device of claim 1, wherein the blockout portion is offset from a longitudinal axis of the buckle.

11. The device of claim 3, wherein the latch member pivots in response to actuation by the button, and the posts move in unison along with the latch member.

12. A buckling system for retaining a seatbelt for use in a passenger vehicle, the system comprising:

a latch plate having a base portion and first and second fingers extending from the base portion;

a seatbelt buckle configured to receive and retain the fingers of the latch plate, the seatbelt buckle including a housing adapted for mounting to a vehicle structure, the housing defining an internal cavity, the housing defining a first direction corresponding to a direction of insertion of the latch plate;

an insertion slot defined at least in part by the buckle housing, the insertion slot defining an opening; and a blockout portion disposed in the insertion slot, the blockout portion blocking a portion of the opening and being moveable in the first direction;

the insertion slot having first and second slot portions defined by the buckle housing and the blockout portion;

wherein the first and second slot portions are sized and configured to receive the first and second fingers of the latch plate.

13. The system of claim 12, wherein the base portion and the fingers are generally coplanar.

14. The system of claim 12, further comprising an ejector disposed within the buckle, wherein the ejector is biased toward the opening and is reciprocally moveable within the housing, the ejector will translate away from the opening in response to insertion of the latch plate into the insertion slot, the ejector includes an ejector protrusion extending toward the opening, and the blockout portion comprises the ejector protrusion.

15. The system of claim 12, wherein the first finger is wider than the second finger, and the first slot portion is wider than the second slot portion.

16. The system of claim 12, wherein the first finger and second finger are the same width, and the first slot portion and second slot portion are the same width.

17. The system of claim 12, wherein buckle includes a depressible button disposed within the buckle housing, the blockout portion, and the depressible button are a unitary structure.

18. The system of claim 12, wherein the first and second fingers and the base portion of the latch plate are a unitary structure.

19. The system of claim 12, wherein the first and second fingers each define a window, and the buckle includes a moveable latch member having a pair of posts, wherein the posts are configured to be received in the windows to retain the latch plate.

20. The system of claim 19, wherein the windows have one of a square, rectangle, circle, or triangle shape.

* * * * *